US010519654B2

(12) United States Patent
Darwell

(10) Patent No.: US 10,519,654 B2
(45) Date of Patent: Dec. 31, 2019

(54) BUILDING COMPONENT

(71) Applicant: CSR BUILDING PRODUCTS LIMITED, North Ryde, New South Wales (AU)

(72) Inventor: Stephen W. Darwell, North Ryde (AU)

(73) Assignee: CSR BUILDING PRODUCTS LIMITED, North Ryde, New South Wales (AU)

( * ) Notice: Subject to any disclaimer, the term of this patent is extended or adjusted under 35 U.S.C. 154(b) by 0 days.

(21) Appl. No.: 15/035,453

(22) PCT Filed: Nov. 7, 2014

(86) PCT No.: PCT/AU2014/001037
§ 371 (c)(1),
(2) Date: May 9, 2016

(87) PCT Pub. No.: WO2015/066758
PCT Pub. Date: May 14, 2015

(65) Prior Publication Data

US 2016/0289960 A1 Oct. 6, 2016

(30) Foreign Application Priority Data

Nov. 7, 2013 (AU) ..... 2013904314

(51) Int. Cl.
*E04B 2/86* (2006.01)
*E04B 1/61* (2006.01)
(Continued)

(52) U.S. Cl.
CPC ..... *E04B 2/8629* (2013.01); *E04B 1/6137* (2013.01); *E04B 2/8635* (2013.01);
(Continued)

(58) Field of Classification Search
CPC ... E06B 9/56; E06B 9/78; E06B 9/689; E06B 9/62; E06B 9/66; E06B 9/80; E06B 9/90; E06B 2009/785
(Continued)

(56) References Cited

U.S. PATENT DOCUMENTS 2,164,681 A * 7/1939 Fould ..... E04C 2/08 160/235
3,301,147 A * 1/1967 Clayton ..... E01C 9/083 404/35
(Continued)

FOREIGN PATENT DOCUMENTS

AU 2008202281 B1 7/2009
CA 957816 11/1974
(Continued)

OTHER PUBLICATIONS

Australian Examination Report for Application No. 2015100793 dated Aug. 7, 2015 (6 pages).
(Continued)

*Primary Examiner* — Jeanette E Chapman
(74) *Attorney, Agent, or Firm* — Michael Best & Friedrich LLP

(57) ABSTRACT

A building formwork component comprising first and second spaced sidewalls having one or more webs extending there-between, each sidewall comprising a flange extending inwardly along a first edge of the sidewall such that an outer surface of the flange forms a ramp surface; and a groove extending along an opposing second edge of the sidewall; wherein the component may be coupled to a like component by relative movement of the components towards each other, whereby the flanges are received in respective grooves of the like component, and whereby the ramp surfaces facilitate such coupling by engaging respective second edges of the
(Continued)

like component to move the second edges and/or ramp surfaces for engagement of the flanges in the grooves.

18 Claims, 8 Drawing Sheets

(51) Int. Cl.
*E04C 2/36* (2006.01)
*E04C 2/38* (2006.01)
*E04C 2/34* (2006.01)
*E04B 1/12* (2006.01)

(52) U.S. Cl.
CPC ..... *E04B 2/8652* (2013.01); *E04C 2/3405* (2013.01); *E04C 2/36* (2013.01); *E04C 2/38* (2013.01); *E04B 1/12* (2013.01); *E04B 1/6129* (2013.01)

(58) Field of Classification Search
USPC ..... 52/426
See application file for complete search history.

(56) References Cited

U.S. PATENT DOCUMENTS 3,369,568 A * 2/1968 Davis ..... B21D 51/28 138/168
3,397,496 A * 8/1968 Sohns ..... E04L 31/54 52/284
3,472,224 A * 10/1969 Ewerwahn ..... A61F 5/04 297/423.1
3,562,992 A 2/1971 Kinsey
4,023,374 A * 5/1977 Colbert ..... E02D 5/64 138/159
4,104,837 A * 8/1978 Naito ..... B62D 27/06 52/239
4,316,351 A * 2/1982 Ting ..... E04C 2/292 52/309.9
4,433,522 A * 2/1984 Yerushalmi ..... E04H 9/10 52/249
4,505,082 A * 3/1985 Schmitz ..... E04C 2/292 52/309.8
5,201,159 A 4/1993 Goranson
5,247,773 A 9/1993 Weir
5,293,728 A * 3/1994 Christopher ..... F16B 5/0016 52/309.9
5,311,718 A * 5/1994 Trousilek ..... E04B 2/8629 52/421
5,459,971 A * 10/1995 Sparkman ..... E04B 2/8617 52/105
5,465,545 A * 11/1995 Trousilek ..... E04B 2/8629 52/421
6,212,845 B1 4/2001 De Zen
6,247,280 B1 6/2001 Grinshpun
6,314,701 B1 * 11/2001 Meyerson ..... E04C 2/292 52/309.9
6,435,471 B1 * 8/2002 Piccone ..... E04B 2/8641 249/191
6,658,808 B1 12/2003 Doherty
6,769,835 B2 * 8/2004 Stridsman ..... E04F 15/02 404/41
7,090,430 B1 * 8/2006 Fletcher ..... E01C 9/086 404/35
7,131,161 B2 * 11/2006 Lee ..... E01D 19/125 14/73
7,364,383 B2 * 4/2008 Fletcher ..... E01C 9/086 404/35
7,444,788 B2 * 11/2008 Morin ..... E04B 2/8641 52/425
7,614,199 B2 * 11/2009 Smalley ..... E04B 1/14 52/235
7,628,570 B2 * 12/2009 Davidsaver ..... E02B 3/06 405/284
7,703,248 B2 * 4/2010 Dincel ..... E04B 2/8629 264/209.1
7,739,848 B2 * 6/2010 Trout ..... E04D 3/352 52/309.15
7,827,752 B2 11/2010 Scherrer
7,849,655 B2 * 12/2010 Chen ..... E04F 13/18 52/177
8,037,652 B2 10/2011 Marshall et al.
8,741,418 B2 * 6/2014 Kordelin ..... B21D 47/00 428/166
9,279,261 B2 * 3/2016 Schneider ..... E04G 9/06
9,850,658 B2 * 12/2017 Alcala Ordaz ..... E04B 2/8635
9,982,444 B2 * 5/2018 Richardson ..... E04G 17/00
2003/0101681 A1 6/2003 Tychsen
2004/0045238 A1 3/2004 Dunn et al.
2004/0244321 A1 * 12/2004 Dincel ..... E04B 2/8629 52/503
2005/0053429 A1 3/2005 Davidsaver
2005/0160831 A1 7/2005 Hopf et al.
2006/0005497 A1 1/2006 Foell et al.
2008/0016810 A1 1/2008 Cooper et al.
2010/0212241 A1 8/2010 Holroyd
2014/0026509 A1 1/2014 Dincel

FOREIGN PATENT DOCUMENTS

CN 2173818 Y 8/1994
CN 1149328 A 5/1997
DE 2657106 C3 11/1980
EP 0522541 1/1996
JP 2001348862 12/2001
WO 199600799 3/1996
WO WO-2012139153 A1 10/2012
WO 2013075250 5/2013
WO WO-2015192179 A1 * 12/2015 ..... E04B 2/8629

OTHER PUBLICATIONS

International Search Report and Written Opinion for Application No. PCT/AU2014/001037 dated Feb. 16, 2015 (16 pages).
Notification of Transmittal of International Preliminary Report on Patentability for Application No. PCT/AU2014/001037 dated Feb. 24, 2016 (73 pages).
The Royal Building System Construction Guide, issued Jun. 1998 (145 pages).
European Search Report for Application No. 14860659.3 dated Mar. 24, 2017 (8 pages).

* cited by examiner

BUILDING COMPONENT

TECHNICAL FIELD

A building formwork component, a system of building formwork components and a method for constructing a wall are disclosed.

BACKGROUND

Formwork is used in the construction of buildings and other structures to provide a temporary or permanent mould into which concrete or other similar materials may be poured.

Stay-in-place formwork that comprises a number of components, some which can be formed of plastic, is also known in the art.

The above references to the background art do not constitute an admission that the art forms part of the common general knowledge of a person of ordinary skill in the art. The above references are also not intended to limit the application of the building formwork component, system and method as disclosed herein.

SUMMARY OF DISCLOSURE

Disclosed herein is a building formwork component. Also disclosed is a system that employs a number of the building formwork components, as well as a method for constructing a wall using such components. The component, system and method find particular, though not exclusive, application in the construction of buildings and other structures. The component can provide and form part of a stay-in-place building formwork.

In a first aspect a building formwork component is disclosed. The building formwork component comprises first and second spaced sidewalls having one or more webs extending therebetween. Each sidewall comprises a flange that extends inwardly along a first edge of the sidewall such that an outer surface of the flange forms a ramp surface. Each sidewall further comprises a groove that extends along an opposing second edge of the sidewall.

The component may be coupled to a like component (i.e. that is the same as or substantially similar to the first-mentioned component). This coupling can occur by relative movement of the components towards each other. During this coupling the flanges can be received in respective grooves of the like component. The ramp surfaces facilitate such coupling by engaging respective second edges of the like component to move the second edges and/or ramp surfaces for engagement of the flanges in the grooves. This coupling can be such that the components are now ready to receive a cementitious material therein (e.g. functioning as a stay-in-place formwork).

In one embodiment an inner surface, opposing the outer surface, of each flange forms an acute angle with its respective sidewall. In this embodiment the inner surfaces of the flanges form an acute angle with their respective sidewalls, but in other embodiments the gap formed between the flanges and their respective sidewalls can be filled in with material (i.e. without affecting the function of the flanges). In this regard, each flange may have a triangular cross-sectional profile that extends along the edge of the sidewall.

The spaces formed between the walls and webs of the building formwork component may, for example, have a cementitious material such as concrete poured therein, in use. In this respect, the building formwork component may be suitable for constructing building structures (e.g. walls, flooring, roofs etc.). In some embodiments, the building formwork component may be suitable for use without infill (e.g. cementitious material). For example, the formwork component may be used as a non-structural support member, or may alternatively be formed so as to be suitable for us as a structural member (i.e. for supporting loads).

The component may be formed of plastic (e.g. PVC), or it may be formed of a composite material, or from a metal such as steel. When formed of plastic or a composite, the component may be e.g. injection moulded or extruded. In this regard, the component may be suitable for mass production.

The relative movement of the components towards each other may be a linear movement, whereby both edges of the component may be aligned simultaneously with the corresponding edges of a like component and then engaged with the edges of the like component (i.e. at the same time). For example, the components may be coupled by being displaced relatively towards each other until e.g. a snap-locking inter-engagement occurs.

Alternatively, the relative movement may be a pivoting or rotational movement. In this respect, a flange of the component may first be received in a corresponding groove of a like component to align/connect those edges of the components. Then, the components may be pivoted about the axis formed along the connected edges, and until the opposing edges come into engagement, and such that a snap-locking inter-engagement can occur.

In one embodiment the sidewalls may be arranged symmetrically such that the flanges may be located in a first end region of the component and the grooves may be located in an opposing second end region of the component. A symmetrical arrangement may allow coupling of the component to a like component in several orientations. Thus in use, minimal re-orientation of the building formwork component may be required prior to it being coupled to a like component.

In another embodiment the sidewalls may be arranged asymmetrically, such that one flange and one groove may be located in each of a first end region and an opposing second end region of the component. This arrangement may be suitable, for example, if the component is intended to be used in only one orientation.

In one embodiment at least one of the one or more webs may extend between the sidewalls in proximity to the flanges. This can inhibit movement of the sidewalls adjacent to the flanges during coupling. In this embodiment, the engagement of the flanges in the grooves may be facilitated by flex of the walls adjacent to the grooves (i.e. due to limited flex of the sidewalls adjacent to the flanges). Additionally or alternatively, the flanges themselves may deform and/or deflect to allow coupling of the components (e.g. in a snap-locking inter-engagement).

Also in this embodiment, the component may be configured such that, when the component is coupled to a like component, the grooves of the first-mentioned component may be located between the respective flanges of the like component. When a cementitious material e.g. concrete is poured into the component, it may cause the walls of the component to flex outwards (e.g. due to hydraulic pressure from the concrete). Further, the portion of the wall is which the grooves are located may be more susceptible to flexing. Thus, by locating the grooves between the flanges, this can help to inhibit their respective walls from moving (flexing) outwards (i.e. which may otherwise cause concrete to leak at the joint of the coupled components). The flexing of the walls outwards, due to the hydraulic pressure of the concrete, increases the strength of the seal between the coupled flanges and grooves. This may help to prevent the ingress of water into, and through, the building formwork component via the connected edges of coupled elements.

In one embodiment at least one of the one or more webs may extend between the sidewalls in proximity to the grooves. Again, this can inhibit movement of the sidewalls adjacent to the grooves during coupling. In this embodiment, the engagement of the flanges in the grooves may be facilitated by flex of the walls adjacent to the flanges (i.e. due to the movement of the sidewalls adjacent the grooves being inhibited). Again, the coupling of the components may further be facilitated by deformation and/or deflection of the flanges themselves.

Also in this embodiment, the component may be configured such that, when the component is coupled to a like component, the flanges of the first-mentioned component may be located between the respective grooves of the like component. Again, when e.g. concrete is poured into the component, it may cause the walls of the component to flex outwards (e.g. due to hydraulic pressure from the concrete). Further, the portion of the wall is which the flanges are located may, in this embodiment, be more susceptible to flexing. Again, by locating the flanges between the grooves, this can help to inhibit their respective walls from moving (flexing) outwards (i.e. which may otherwise cause concrete to leak at the joint of the coupled components).

In an embodiment where at least two webs are present in the component, the webs may be arranged such that one web extends between the sidewalls in proximity to the grooves, and another web extends between the sidewalls in proximity to the flanges. In this embodiment, movement of the sidewalls adjacent to both the flanges and grooves would be inhibited (i.e. flex of the sidewalls in these regions would be limited). Thus, engagement of the flanges in the grooves would largely be facilitated by deformation and/or deflection of the flanges themselves.

In one embodiment each groove may be formed so as to correspond to a respective flange of a like component. In this embodiment, the flange may be closely received in the groove when the component is coupled to a like component. Once the components have been coupled, such a close receipt can inhibit relative movement of the components away from or towards each other. The close receipt can also facilitate a flush connection between the sidewalls of coupled components. A flush surface can provide a continuous wall requiring minimal surface finish.

In one embodiment each flange may be configured such that a distal end thereof abuts an inner surface of a respective groove in the like component. This can further prevent lateral movement of the components away from one another when coupled.

In a second aspect a building formwork component is disclosed. The building formwork component comprises first and second spaced sidewalls having one or more webs extending therebetween. The component further comprises first and second end regions, each end region configured for connecting the component to an end region of a like component. A first edge of the first sidewall in the first end region is configured to be connected to an edge of an end region of a like component. A second edge of the second sidewall in the first end region is configured to snap-engage with the other edge of the end region of the like component by pivoting the component about an axis formed along the first edge, when connected.

In this respect, once the first edges are connected (i.e. the edges about which the component is pivoted), movement of the components relative to one another may be restricted to pivoting about a single axis. Thus, in use, a user may only be required to align a single edge of the component with a single edge of a like component (i.e. the first edges) in order to couple the components together (i.e. rather than simultaneously having to align the first and second edges of the component with the first and second edges of a like component). The component of the second aspect may accordingly lend itself to use by relatively unskilled contractors, labourers, etc.

In some forms, the component may be cumbersome (i.e. large and relatively heavy), which may make it more difficult (e.g. for a single user) to simultaneously align two edges of the component with two edges of a like component. The pivoting arrangement of the component of the second aspect may thus provide for a simpler coupling action.

In one embodiment each edge in the second end region may comprise an inwardly projecting flange that may extend along the edge.

In one embodiment each flange may extend generally perpendicularly to its respective sidewall, and may project towards each other flange.

In an alternative embodiment one flange may extend generally perpendicularly to its respective sidewall, and the other may extend such that an inner surface of the flange forms an acute angle with its respective sidewall and such that an opposing outer surface of the flange forms a ramp surface. In this case, the single axis on which the components pivot can extend along the perpendicular flange, and the ramp surface may facilitate a snap engagement of the acutely-angled flange when the component is pivoted into connection with the like component.

In one embodiment, when the flanges extend generally perpendicularly to the sidewalls and towards one another, each flange may extend from the sidewall to the same extent as the other flange. In this respect, the flanges may be symmetrical about a plane of symmetry formed between the flanges and parallel to the sidewalls. This allows the component to be coupled to a like component in more than one orientation (i.e. it may still be suitable for coupling when inverted).

In one embodiment each edge in the first end region may comprise a groove formed in the sidewall that extends along the edge.

In one embodiment at least one of the edges in the first end region may comprise a ramp surface adjacent to the respective groove in the edge. The ramp surface may be configured for engagement with a corresponding flange, to facilitate the passing of a distal end of the flange across the ramp surface, until it aligns with the groove, whereby a snap-engagement of the flange into the respective groove can occur. The ramp can particularly facilitate movement of the perpendicular flange there-across.

In one embodiment, when each flange extends generally perpendicularly to its respective sidewall, each groove may have a generally U-shaped profile (e.g. the U-shape being optimised to receive the perpendicular flange therein).

In another embodiment, when one flange extends such that it forms an acute angle with the sidewall, a corresponding groove may have a generally V-shaped profile (i.e. that corresponds and is optimised to the outer surface of the acute flange, whereby the acute flange of a given component may be snugly received in the corresponding groove when coupled thereto). As set forth above, such snug receipt of the flange in the groove may prevent relative movement of the coupled components away from or towards each other. It can also facilitate alignment of one component with respect to the other, thus allowing flush alignment of the sidewalls of coupled components (requiring minimal surface finish). A close fit between the flanges and corresponding grooves may also help to prevent water ingress between the coupled components. Water ingress may be further prevented by the arrangement of the webs, whereby the hydraulic pressure of concrete (or other cementitious material) poured between two coupled building formwork components forces the gaps between their respective flanges and grooves to be closed (i.e. due to flexing of the walls).

In one embodiment at least one of the one or more webs may be located in proximity to the flanges, so as inhibit movement of the sidewalls adjacent to the flanges and/or grooves during snap engagement.

In a third aspect a building formwork component is disclosed. The building formwork component comprises first and second spaced sidewalls having at least one web extending therebetween. Each sidewall comprises at least two generally parallel flanges extending from a first edge region of the sidewall, such that a recess is formed between the flanges. Each sidewall further comprises at least two generally parallel flanges extending from a second edge region of the sidewall, such that a recess is formed between the flanges. At least one of the sidewalls comprises a longitudinal ridge projecting laterally from at least one flange of the first edge. The sidewall further comprises a corresponding groove extending along at least one flange of the second edge. The groove is arranged for receipt of the ridge of a like component. The component may be coupled to the like component by interdigitation (or interleaving) of the flanges of the first-mentioned component with the flanges of the like component. When the first-mentioned component is coupled to the like component, the ridge can be received in the groove to prevent relative lateral movement of the components away from one another. Also, the location of the ridge in the groove may also help to retain the flange (i.e. on which the ridge is located) in the recess of the like component, again inhibiting movement. In this embodiment, the interdigitation of the flanges may help to reduce or eliminate the ingress of water into and through the building component. In particular, the interdigitation arrangement increases the length and complexity of the path which water (or other liquids) must take in order to pass through the joint.

In one embodiment both sidewalls can comprise the longitudinal ridge that projects laterally from a respective flange of the sidewall's first edge. Both sidewalls may further comprise a corresponding groove extending along a respective flange of the sidewall's second edge. In other words, where two components are connected, an inter-aligned ridge and groove can be provided along each side of the connection, thereby enhancing the coupling of the components. Again, and as set forth above, the hydraulic pressure of concrete (or other materials) that is poured between two coupled building formwork components may force the interconnected flanges together, thereby improving the seal formed between the components.

The arrangement of the flanges such that they are interdigitated (interleaved) when the components are coupled can increase the length of path that water must travel in order to enter the interior of the component (i.e. at the connection between the component and the like component). Thus, this arrangement can help to provide a waterproof connection between the components. Similarly, the location of the ridge in a respective groove may provide further sealing between the component and like component and thus improved waterproofing (i.e. by making the potential water path even more tortuous).

In one embodiment, each first and second edge may comprise two parallel flanges (each pair of flanges having a recess formed therebetween) that extend so as to be parallel to their respective sidewall. Again, this can enhance the degree of interdigitation (interleaving).

In one embodiment the (or each) ridge may comprise a ramp surface to facilitate the passage between parallel flanges of that flange having the ridge, as well as facilitating snap-engagement of the ridge in its respective groove. In this regard, when the component is moved towards a like component, the ramp surface may engage a distal end of a flange of a like component (i.e. as it is moved between the flanges of the like component). In doing so, the ramp surface may engage with and displace one of the flanges, such that the width of the recess formed between the flanges increases (i.e. the flange is caused to flex away from the other flange due to its engagement with the ramp surface on the ridge). Once the ridge aligns with the groove, the flange will snap back into its original position, this action completing the coupling of the component to the like component.

In one embodiment at least one (and usually both) of the flanges may comprise a ramp surface on a distal end of the flange. The (or each) ramp surface can be arranged to facilitate alignment and interdigitation (interleaving) of the flanges during coupling of the component with a like component. The (or each) ramp surface may, for example, take the form of an angled surface on the distal end of the flange, or may comprise a curved surface.

In one embodiment each outermost flange of each first edge may be inset from the surface of the sidewall. The inset may be such that, when coupled to a like component, the outermost flanges of the like component may be received outside the inset flanges. Further, the inset may be such that a flush surface is formed with the respective sidewalls of the components. A flush surface may be desirable if, for example, the surface is to be used as a wall with minimal finish applied.

In one embodiment the recesses formed between the flanges of the first and second edge regions of the first sidewall may be deeper than the recesses formed between the flanges of the first and second end regions of the second sidewall. In other words, the flanges of the first sidewall may be longer (i.e. extend further from the end of the sidewall) than the flanges of the second sidewall. Thus, when the component is coupled to a like component, the flanges of the first sidewalls (i.e. of the component and like component), can engage prior to the components of the second sidewalls. As the flanges of the first sidewalls engage, they can thereby facilitate alignment of the flanges of the second sidewalls (i.e. prior to the latter engaging). In other words, in order to couple the components, and instead of a user needing to align the flanges of both sidewalls with the flanges of the like component, the user only need align the first sidewalls. This can result in simpler and faster coupling.

In a fourth aspect a building formwork component is disclosed. The building formwork component comprises first and second spaced sidewalls having at least one web extending therebetween. At least one edge of the first and second spaced sidewalls is configured for slidable engagement (i.e. longitudinally) with an edge of a like component. The at least one edge of the component and the edge of the like component are also configured such that the like component is first able to be arranged in close-facing engagement with a surface of the first-mentioned component. When so arranged, the at least one edge of the component becomes aligned for slidable engagement (i.e. longitudinally) with the edge of the like component although it is not yet coupled thereto. The at least one edge component and the edge of the like component are further configured such that the component is able to be slid (i.e. longitudinally) relative to the like component, whereby the components then become coupled, and such that lateral movement of the components is inhibited.

The alignment and then engagement of multiple building formwork components can be cumbersome and time consuming. This may especially be the case at e.g. a building site where a contractor or labourer may be unskilled, or where a user may be fatigued. The building formwork component of the fourth aspect enables alignment of the components prior to their slidable engagement which can provide for a simpler coupling procedure. It may also reduce time, labour costs and worker fatigue.

For example, the configuration of the components may be such that the at least one edge may be brought into abutment with the like component. This abutment can be used to align the like component along an axis of slidable engagement. This abutment may, for example, result in two flat surfaces (i.e. one on each of the components) becoming aligned along the axis of slidable engagement.

To facilitate the sliding engagement and coupling of the components, each sidewall may comprise a first end that has a groove extending partway therealong and an opposing second edge having a flange extending partway therealong. The groove can be configured to slidingly receive therein the flange of a like component, whereby the flange and groove inter-engage to thereby couple the components.

In one embodiment, each groove may be defined by a channel having a generally U-shaped profile. When the component is viewed in end profile, one sidewall of the U-shaped channel may extend inwardly from its respective first or second component sidewall. The other channel sidewall may comprise a cut-away therein. This cut-away can enable the edge of the like component to initially be brought into close-facing engagement with the first channel sidewall (i.e. aligned ready for longitudinal sliding).

In one embodiment the cut-away may be located at the top and/or bottom of the channel. Alternatively or additionally, the sidewall may comprise a plurality of cut-aways spaced out there-along. These cut-aways may correspond to respective cut-aways on the flanges such that, when the components are coupled, the portions of the flange that are not cut-away may be received through the cut-aways in the groove and vice-versa. In this way the components may be coupled together, firstly by moving them laterally, relatively towards each other, thereby aligning them along the axis of slidable engagement. Once aligned, then sliding the components relative to one another along the axis of slidable engagement to inter-align and thus interlock the portions of the groove and flange that are not cut-away.

Building formwork components according to the fourth aspect may be further configured such that, when coupled, adjacent sidewalls form a generally flush surface (thereby requiring minimal surface finish).

In an embodiment of any one of the first to fourth aspects as set forth above, the at least one web may comprise at least one aperture therethrough. In embodiments that are intended for use with a cementitious material such as concrete, or other fill material, the apertures may allow for material flow between the webs, thereby reducing the possibility of air pockets and gaps forming within the component (i.e. where fill material is not present). Similarly, the apertures allow the cement, when hardened, to form a continuous structure (i.e. rather than separate structures formed between the webs). This may improve the strength properties of the final composite structure (i.e. building formwork component and hardened cementitious material). Moreover, the web apertures can reduce the volume of material required to manufacture the component, thereby making the component cheaper and reducing its weight. In this respect, the component is designed to locate the apertures such that a deleterious effect on the structural properties of the component is minimised.

In an embodiment of any one of the first to fourth aspects as set forth above, the component may comprise a plurality of webs, each web having at least one aperture. The apertures in the webs can be aligned along a common axis that extends transversely through the component. The aligned apertures can allow coupled components to be used together with reinforcing, such as e.g. steel reinforcing rod or bar. In this regard, the reinforcing bar may be passed through the aligned apertures of multiple coupled components. When the reinforcing bar becomes embedded in e.g. a cementitious material poured into the multiple coupled components, it can provide additional strength to the resultant composite structure (e.g. to a building).

In an embodiment of any one of the first to fourth aspects as set forth above, the profile of at least one of the aperture may be such that it comprises first and second opposing convex edges and third and fourth opposing concave edges. The convex edges may be oriented such that they form the bottom and top edges of the at least one aperture. This defines an aperture shape whereby when e.g. two reinforcing bars are passed through each aperture, the bars may rest in respective and opposite lower corners of each aperture. Moreover, where the component has a symmetrical profile, such that location of the bars is not affected by the orientation of the component (i.e. upright or inverted).

Further, the aforementioned profile of each aperture can avoid placement of a reinforcing bar or rod near to an outer surface of the fill material poured into the multiple coupled components. In this regard, the concave side edges of each aperture (i.e. that bow outwards towards the sidewalls) can result in an inset placement of each reinforcing bar, relative to the adjacent sidewall, whilst still allowing for an increased size of each aperture. Maximising aperture size can allow a larger flow of cementitious material between the webs. In this respect, a more substantial connection of cementitious material is formed across and between the webs (i.e. such that the webs themselves provide minimal disturbance to the continuity of the wall structure). This can provide a stronger composite (i.e. building formwork component and cementitious material) structure.

The profile of at the least one of the aperture may also be easy to manufacture, whereby simple shapes (i.e. lacking intricate detail) may be easier to mould or cut out.

The apertures may alternatively be rectangular, circular, ovoid, elongate etc. Each component may have several apertures of different shapes. Each web may also have multiple discrete apertures extending and spaced out there-along.

In a fifth aspect a building formwork component is disclosed. The building formwork component is configured for coupling to a like component and comprises first and second spaced sidewalls having at least one web extending therebetween. The at least one web comprises at least one aperture therethrough, whereby the profile of the at least one aperture is such that it comprises first and second opposing convex edges and third and fourth opposing concave edges.

In the fifth aspect of the component, the at least one web may have multiple such discrete apertures extending and spaced out there-along.

In an embodiment of any one of the first to fifth aspects as set forth above, the one or more webs may be arranged such that, when the component is connected to a like component, there can be a space formed between the one or more webs of the component and the one or more webs of a like component coupled thereto. Again, such a space can receive fill (e.g. cementitious) material therein. When this space is filled, the ingress of water between and across the joint of two adjacent components may be reduced or prevented. Even if it is the case that a small crack is formed between the cementitious material and the webs, autogenous healing will take place, which can reduce the crack size and impede the further ingress of water. On the other hand, if the webs of coupled components are adjacent to one another as in prior art arrangements, a small space may form between the webs. In this case, cementitious material may not fill this small space when poured into the components, such that an air gap is left between the webs of the components. In such prior art arrangements water may enter this gap and pass from one side of the coupled building components to the other (i.e. such that the building components having such an arrangement may not provide a waterproof boundary).

In a sixth aspect, a building formwork system comprising a plurality of building formwork components is disclosed. Each component may be as set forth in any one of first to fifth aspects. In the system, the components can be coupled to one another.

The building formwork system may further comprise reinforcing. The reinforcing (e.g. rods, bars, etc) can be arranged to span the coupled components. The reinforcing can also be arranged with respect to one or more apertures in the components.

The building formwork system may further comprise a cementitious material (e.g. concrete) located in the spaces formed between the sidewalls and webs of the components.

In a seventh aspect, a method for constructing a wall is disclosed. The method comprises the step of coupling a plurality of building formwork components to one another. Each building formwork component can be as set forth in any one of the first to fifth aspects. The method further comprises the step of filling the spaces, formed between the sidewalls and web(s) of each building formwork component, with a cementitious material (e.g. concrete).

In one embodiment of the method, prior to filling the spaces with the cementitious material, reinforcing may be arranged to extend through one or more apertures in webs of the components.

BRIEF DESCRIPTION OF THE DRAWINGS

Notwithstanding any other forms which may fall within the scope of the system and device as defined in the Summary, specific embodiments will now be described by way of example only, with reference to the accompanying drawings in which.

DETAILED DESCRIPTION OF SPECIFIC EMBODIMENTS

Figure 1B:
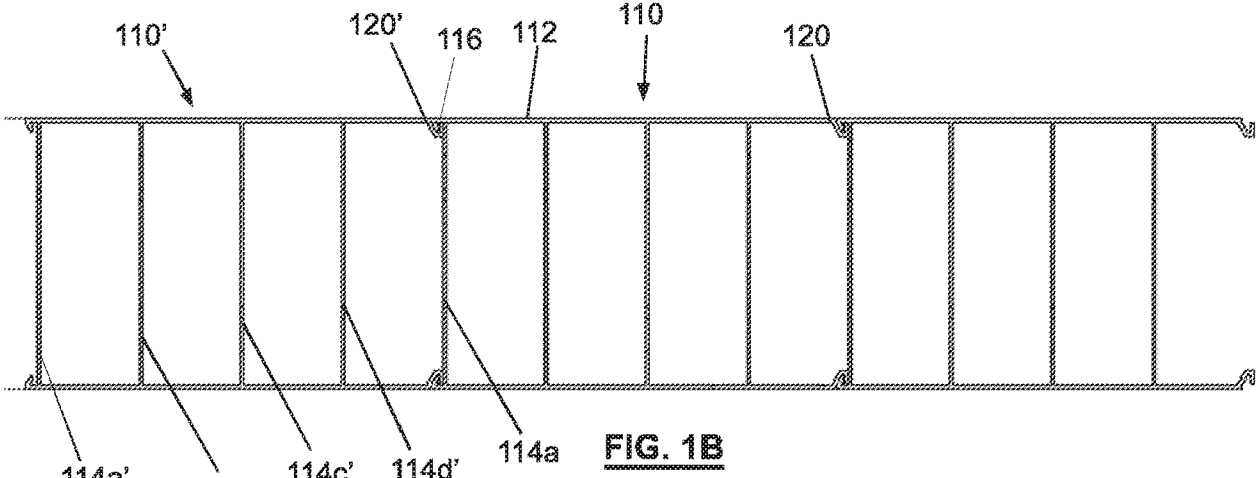
FIGS. 1A to 1G show various views of a first embodiment of the building formwork component.

In the following detailed description, reference is made to accompanying drawings which form a part of the detailed description. The illustrative embodiments described in the detailed description, depicted in the drawings, are not intended to be limiting. Other embodiments may be utilised and other changes may be made without departing from the spirit or scope of the subject matter disclosed herein. It will be readily understood that the aspects of the present disclosure, as generally described herein and illustrated in the drawings can be arranged, substituted, combined, separated and designed in a wide variety of different configurations, all of which are contemplated in this disclosure.

FIGS. 1A to 1G show a first embodiment of the building formwork component 110. The formwork component 110 comprises two parallel spaced sidewalls 112. The sidewalls 112 have webs 114 formed therebetween. The illustrated form comprises four webs 114, however other embodiments may comprise more or less webs. Similarly, the webs 114 in the illustrated embodiment are spaced equidistantly from one another; but in other embodiments the spacing between the webs may be uneven.

Each sidewall 112 comprises a flange 116 extending inwardly (i.e. towards the other sidewall) along a first edge of the sidewall. Each flange 116 extends such that it is directed back along the sidewall 112 such that an inner wall of each flange 116 forms an acute angle with its respective sidewall 112. In this way, the outer surface of each flange 116 (i.e. the surface opposing the inner surface) forms a ramp surface 118.

Each sidewall 112 further comprises a groove 120 formed in the sidewall 112 and extending along a second edge (opposing the first edge) of the sidewall 112. Each groove 120 has a generally V-shape in cross-section such that its profile corresponds to the profile of a respective flange 116 of a like component 110' (i.e. a component having the same form as the illustrated embodiment). In the illustrated form, each groove 120 is formed immediately adjacent to the edge of the sidewall 112 such that it is in the form of an elongate hook-like feature. In other forms one or more of the grooves 120 may be set back from the edge of the sidewall 112 (although still within the vicinity of the edge) such that a small portion of the sidewall 112 extends beyond the groove 120.

Figure 1D:
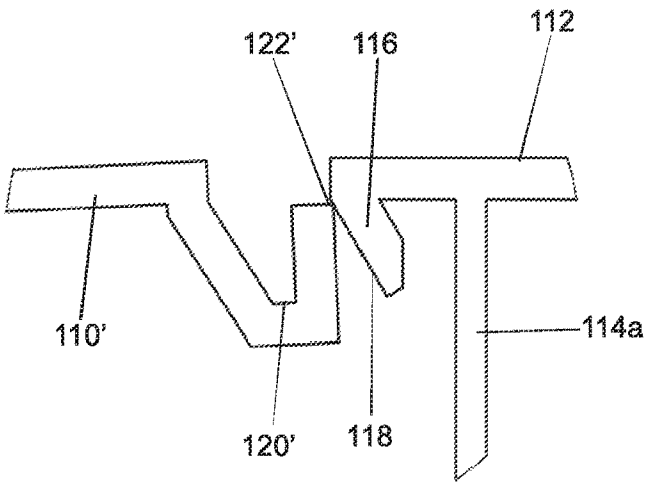
Figure 1C:
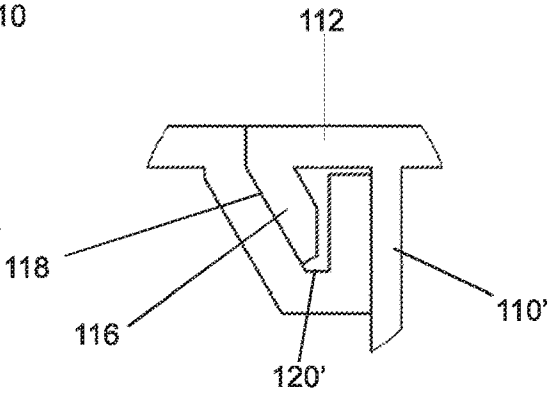
Figure 1A:
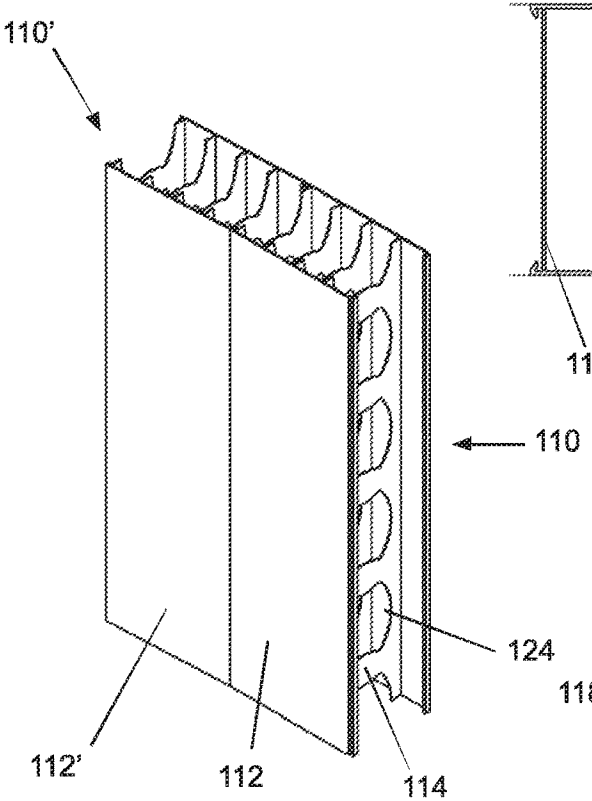

The component 110 may be coupled to a like component 110' (i.e. that is the same or substantially similar to the first-mentioned component) by relative movement of the components 110, 110' towards one another until e.g. a snap-locking inter-engagement occurs. For example, the component 110 may be moved towards the like component 110' such that the flanges 116 of the component 110 are received in respective grooves 120' of the like component 110'. This coupling can be such that the components 110, 110' are ready to receive a cementitious material therein (e.g. functioning as stay-in-place formwork). As shown in FIG. 1D, the ramp surfaces 118 may facilitate such engagement by engaging the edges 122 of the grooves 120 (i.e. the distal ends of sidewalls 112), which may cause the sidewalls 112 to flex outwards.

In the illustrated form, flexing of the sidewalls 112 adjacent to the grooves 120 is facilitated by the location of the webs 114. In particular, the webs 114*d* are arranged such that they are not proximal to the grooves 120. In other words, the length of sidewall 112 between the grooves 120 and the nearest web 114*d* is relatively large to allow for flexing of the sidewalls 112. Further, the flanges 116 and grooves 120 are arranged such that when the component 110 is coupled to a like component 110', the grooves 120 sit between the flanges 116. Thus the flanges 116 prevent the sidewalls 112 adjacent the grooves 120 from flexing outwards. The hydraulic pressure of concrete, when poured into the building component 110 may force the flanges 116 outwards (i.e. moving the flanges 116 into the grooves 120), which may improve the seal formed between the flanges 116 and the grooves 120. This may reduce or prevent the ingress of water into and across coupled building components 110, and at the same time may help to prevent the concrete from leaking from the building components 110, 110' (i.e. through the joints between them).

The webs 114 of the illustrated embodiment are arranged such that when the component 110 is coupled to a like component 110' a space is formed between the outer webs 114*a*, 114*d'* of the components 110, 110'. In use, this space may be filled with concrete which can help to reduce or prevent the ingress of water into the space. Even if a small crack remains between the hardened concrete and the webs 114, autogenous healing will reduce the size of the crack and impede further water entering the space. If the outer webs 114*a*, 114*d'* of the coupled components 110, 110' were arranged such that they abut one another, as in prior art arrangements, then it is possible for a small gap to form between the abutting webs 114*a*, 114*d'* such that water may leak from one side of the coupled building components 110, 110' to the other (i.e. through the gap).

Alternatively or additionally, movement of the component 110 towards a like component 110', and engagement of the ramp surfaces 118 with the second edges, may cause the flanges 116 (i.e. having the ramp surfaces 118) to move. For example, the walls adjacent the flanges 116 may flex outwards, or the flanges 116 themselves may deflect. In the case that the flanges 116 deflect, the entire flange 116 may rotate about the point at which it extends from its respective sidewall 112, or a portion of the flange 116 (i.e. at the distal end of the flange 116) may deflect or deform with respect to the remainder of the flange 116 (e.g. in a snap-locking interengagement).

Figure 1G:
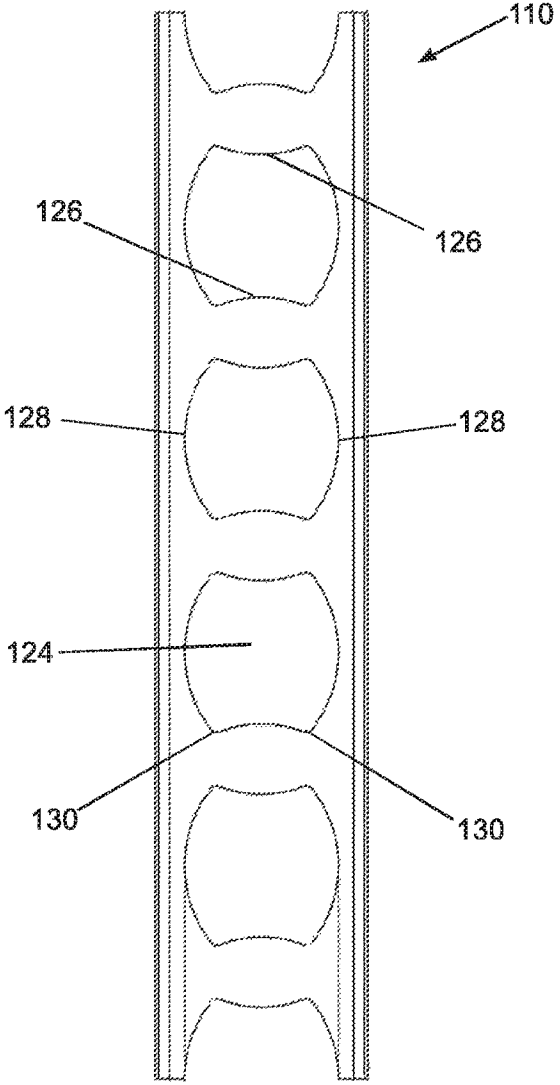
Figure 1E:
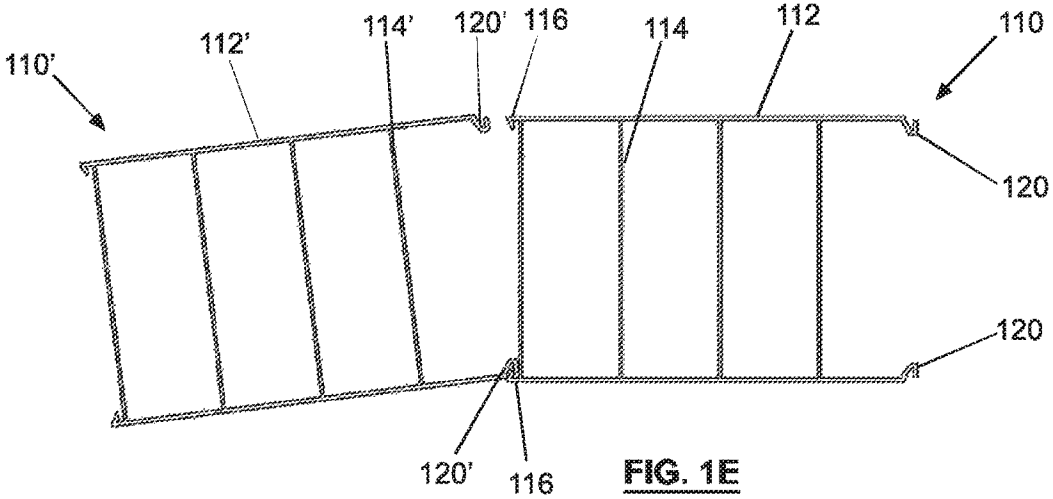
Figure 1F:
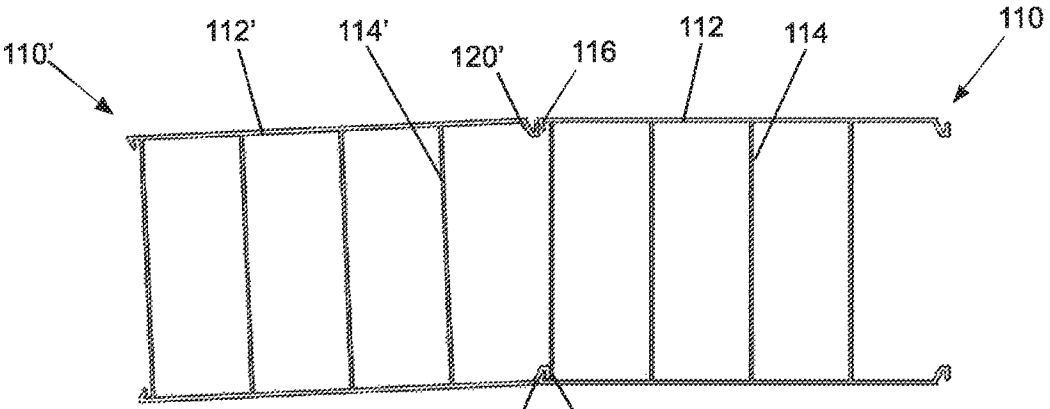
Figure 2B:
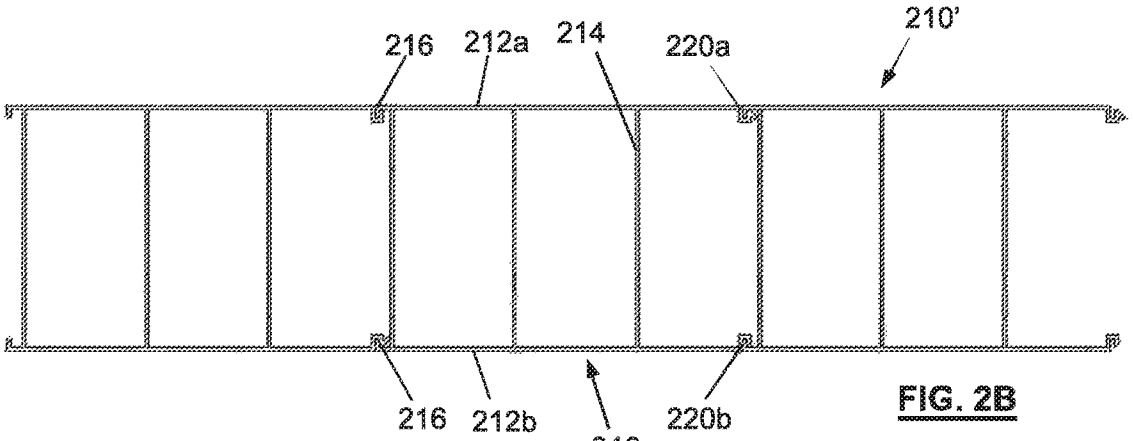
FIG. 2A to 2H show various views of a second embodiment of the building formwork component.
Figure 2F:
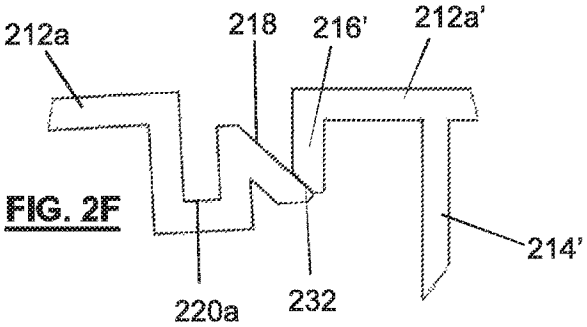
Figure 2D:
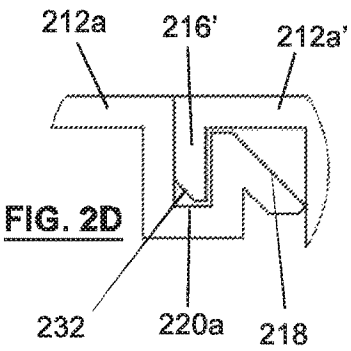
Figure 2E:
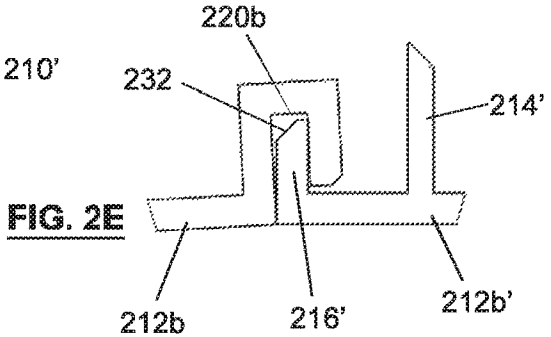
Figure 2C:
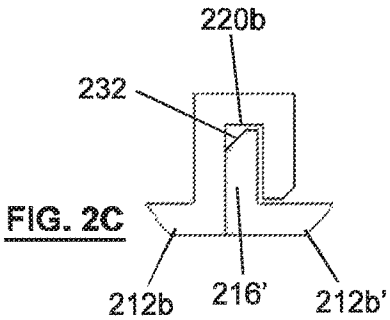
Figure 2A:
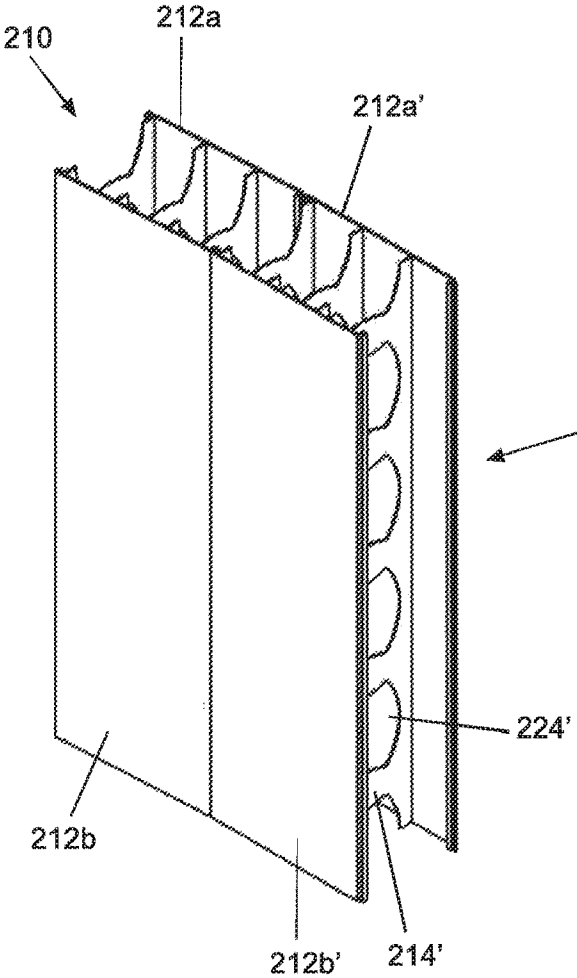
Figure 2G:
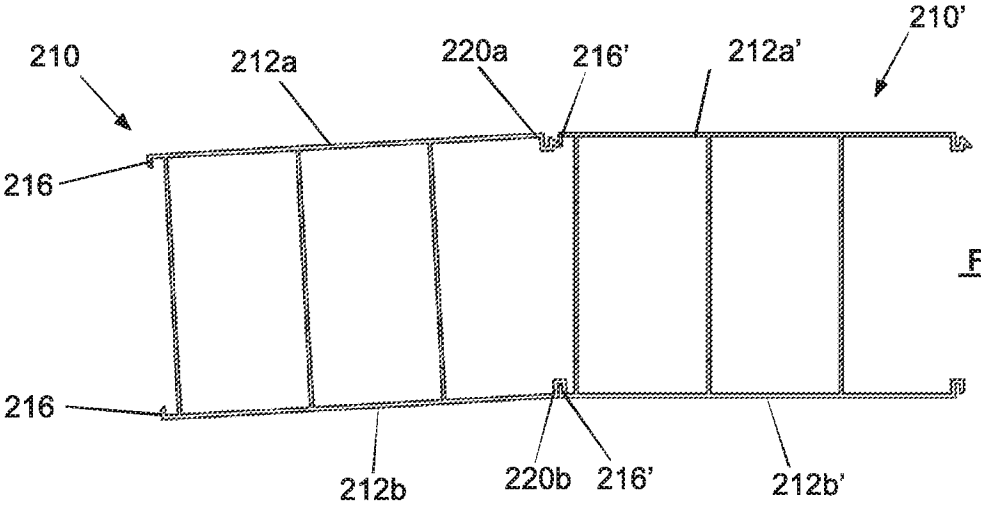
Figure 2H:
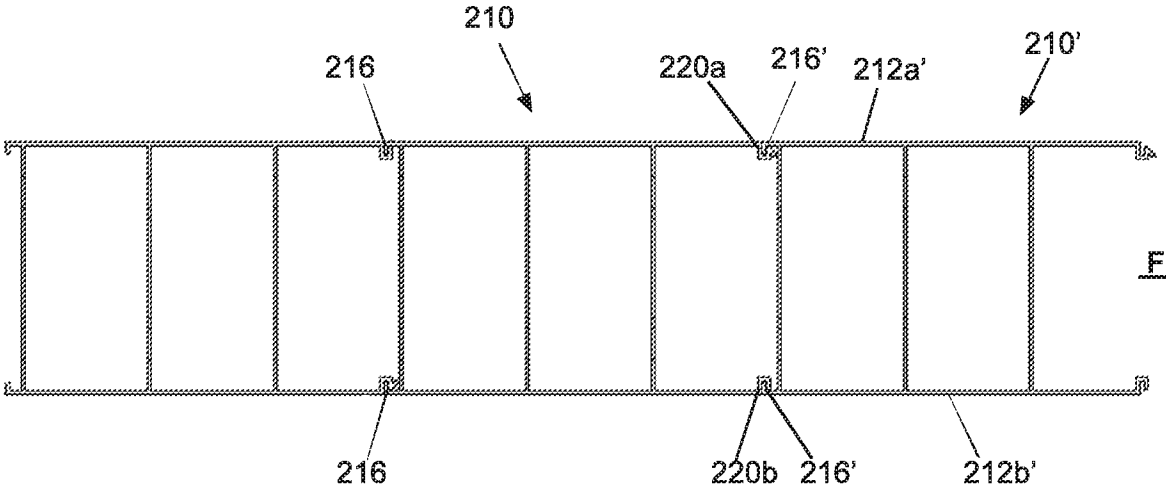
Figure 3A:
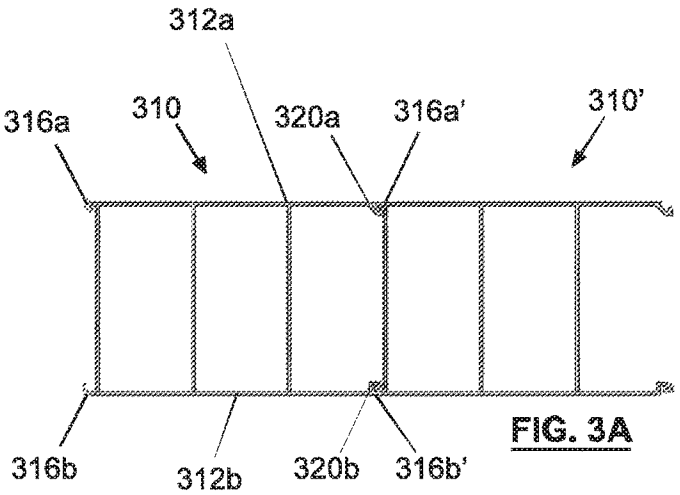
FIG. 3A to 3F show various views of a variation of the second embodiment of the building formwork component.
Figure 3B:
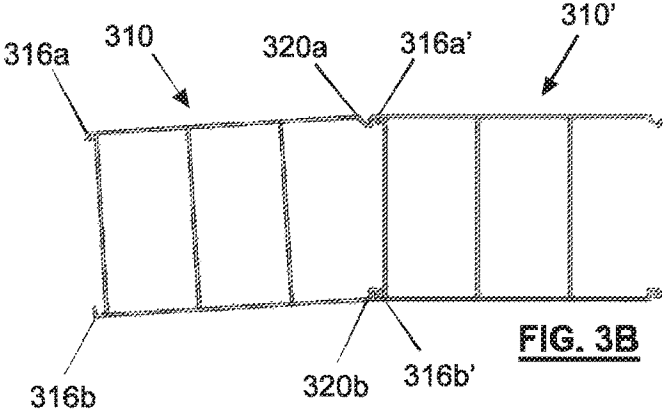
Figure 3D:
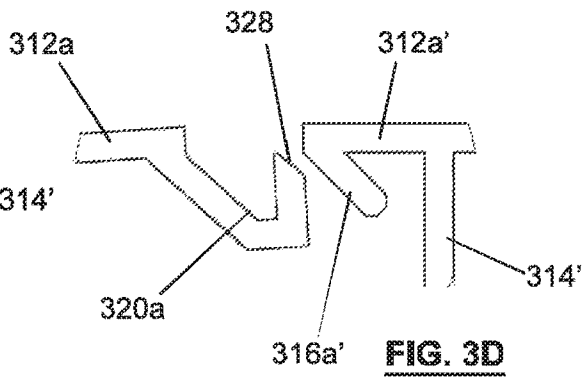
Figure 3C:
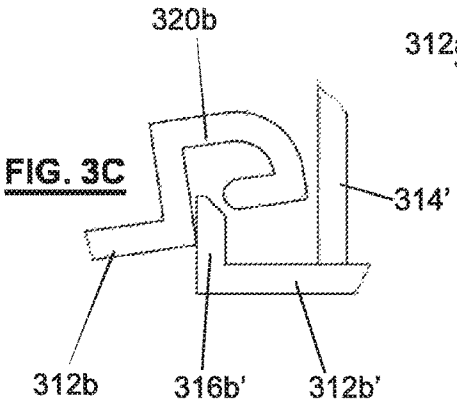
Figure 3F:
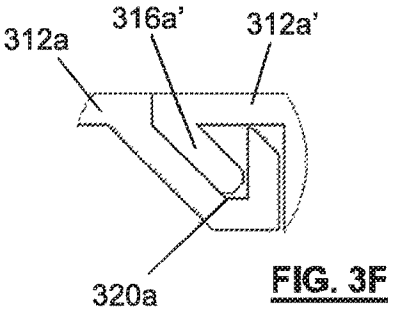
Figure 3E:
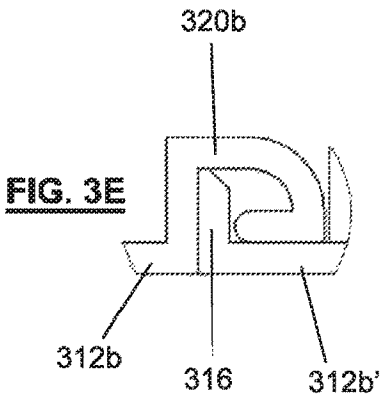

The component 110 may also be coupled with a like component 110' by relative pivoting movements of the components 110 as shown in FIGS. 1E and 1F. For example, the component 110 and like component 110' may first be connected along an edge by alignment of a flange 116 of the component 110 in the corresponding groove 120' of a like component 110'. The components 110 may then be pivoted relative to one another about an axis formed along the connected edges in order to effect snap engagement of the opposing flange 116 and groove 120' (i.e. by engagement of the edge 122 of the groove 120' with the ramp surface 118 for movement of the edge 122 and/or ramp surface 118).

The illustrated form is symmetrical about two axes; one plane of symmetry being formed between, and parallel to, the sidewalls 112 and another plane of symmetry cutting the component 110 in half (i.e. between the top and bottom of the component 110). Such an arrangement allows the component 110 to couple to a like component 110' in more than one orientation. In particular, the component 110 can still be coupled when it is oriented such that it is inverted. This may be convenient, for example, on a building site whereby several building components 110 require coupling to one another (e.g. to form a wall) and they are not necessarily stacked or stored in the correct orientation. Thus in use, minimal reorientation of the component 110 may be required, which may provide faster coupling, thereby reducing the time (and costs) required to build a structure (e.g. wall, roof, flooring, etc.) using multiple formwork components 110.

Each flange 116 fits closely within its corresponding groove 120, such that movement between two coupled components 110, 110' is restricted. This also facilitates alignment of coupled components 110, 110' such that the outer surfaces of the coupled sidewalls 112 are flush (thereby providing a continuous wall requiring minimal surface finish).

Each web 114 comprises multiple apertures 124 therethrough. In particular, in the illustrated form each web 114 comprises four apertures 124. The apertures 124 of each web 114 are aligned such that, in use, reinforcing bar or rod can be passed through them (i.e. such that when the bar or rod becomes embedded in e.g. cementitious material, it can provide additional strength to the resultant composite structure). The apertures 124 may also provide access for services such as electrical wiring and pipes. The profile of each aperture 124, as shown in FIG. 1G is such that it comprises top and bottom convex edges 126 and two side concave edges 128. The corners formed between these edges provide troughs 130 for locating reinforcing bars, wiring etc. The concave side edges 128 of each aperture 124 (i.e. that bow outwards towards the sidewalls 112) can result in an inset placement of each reinforcing bar, relative to the adjacent sidewall 112 (i.e. and thus also away from the outer surfaces of the concrete when formed in the formwork), whilst still allowing for an increased size of each aperture 128. The maximising of the size of the aperture 124 also maximises the flow of the concrete across the webs 114. In this respect, the continuity of the hardened structure is disrupted as little as possible by the presence of the webs 114, thereby leading to a stronger e.g. wall structure. In essence, the series of components function as formwork for a continuous wall.

The profile of the apertures 124 is symmetrical, such that location of the bars is not affected by the orientation of the component 110 (i.e. upright or inverted).

FIGS. 2A to 2H show a further embodiment of the building component 210 comprising parallel sidewalls 212 and webs 214 therebetween. Each sidewall 212 comprises at one edge, a flange 216 that projects inwardly such that it is perpendicular to the sidewall 212 and extends along an edge of the sidewall 212. Both flanges 216 extend from their respective sidewalls 212 to the same extent, such that they are symmetrical about a plane of symmetry between the flanges 216 and parallel to the sidewalls 212. This allows the component 210 to be coupled to a like component 210', even if it is in an upside down orientation.

Each sidewall 212 further comprises at an opposing edge (i.e. at the end of the sidewall 212 opposing the flange 216), a groove 220 extending along the opposing edge. Each groove 220 is in the form of a U-shaped channel that it is optimised to receive a flange 216 therein. An angled flange projects from one of the grooves 220*a*, such that it forms a ramp surface 218 adjacent to the groove 220*a*.

The component 210 may be coupled to a like component 210' by receipt of a flange 216*b'* of a like component 210' in a groove 220*b* of the component 210, such that the groove 220*b* and flange 216*b* form an edge connection between the two components 210. The components 210 may then be pivoted about an axis formed along the connected edges until the flange 216*a*' and groove 220*a* of the opposing sidewalls may be snap engaged. This snap engagement is facilitated by the ramp surface 218 located adjacent the groove 220*a*. In particular, the flange 216*a*' contacts the ramp surface 218, which causes the sidewall adjacent the groove 220*a* to flex, thereby moving the groove 220*a* inwards and allowing receipt of the flange 216*a*' in the groove 220*a*. The distal edge of the flange 216*a*' is filleted, thereby providing a smaller ramp surface 232 which further facilitates the snap engagement.

In the illustrated form there are three webs 214 interconnecting the sidewalls 212. One of these webs 212*a* is arranged such that it is connected between the sidewalls adjacent to the flanges 216. This limits flex in the sidewalls 212 adjacent to the flanges 216, thereby inhibiting movement of the flanges 216 during snap engagement. The flanges 216 are also arranged such that they are located outside the grooves 220 when coupled, such that when e.g. concrete is received in the building components 210, 210' the walls having the grooves 220 flex outwards and force the grooves 220 against the flanges 216 to form a tighter, water-resistant seal.

Each web 214 comprises four apertures 224 for receipt of reinforcing bar, electrical wiring, pipes etc. As in the first embodiment shown in FIGS. 1A to 1G, the profile of each aperture 224 is such that it comprises top and bottom convex edges 226 and two side convex edges 232.

A similar embodiment is shown in FIGS. 3A to 3F, whereby coupling of the component 310 with a like component 310' is effected by connection along a single edge, followed by relative pivoting of the components 310.

In the illustrated form, the first sidewall 312*a* comprises, at one end, a flange 316*a* extending inwardly such that it forms an acute angle with the sidewall 312*a*. The first sidewall 312*a* further comprises, at the other end, a groove 320*a* having a V-shaped profile (i.e. complementing the flange 316*a* extending at an acute angle). The second sidewall 312*b* comprises at one end, an inwardly extending flange 316*b* that is perpendicular to the sidewall 312*b*. At the other opposing end, the second sidewall 312*b* comprises a groove 320*b* having a hook shaped profile.

To couple the component 310 with a like component 310', the perpendicular flange 316*b*' of a like component 310' may be received in the hook shaped groove 320*b* of the component 310 to connect the second sidewalls 312*b*, 312*b*' of the components 310, 310' along an edge. The distal edge of the flange 316*b* is filleted to aid alignment of the flange 316*b* in the hook-shaped groove 320*b*. Similarly, the profile of the hook-shaped groove 320 is such that it fits closely within a recess 334 formed between the flange 316*b* and a web 314*a* adjacent to the flange. This further aids alignment of the components 310, 310'.

In order to effect coupling, the components 310, 310' may then be pivoted relative to one another about the connected edge to snap engage the opposing flange 316*a*' in the V-shaped groove 320*a*. The outer surface of the flange 316*a* provides a ramp surface 318, thereby facilitating the snap engagement. In the illustrated form, the distal edge of the V-shaped groove 320*a* is filleted such that it forms a smaller ramp surface 328 to further facilitate the snap engagement.

Figure 4A:
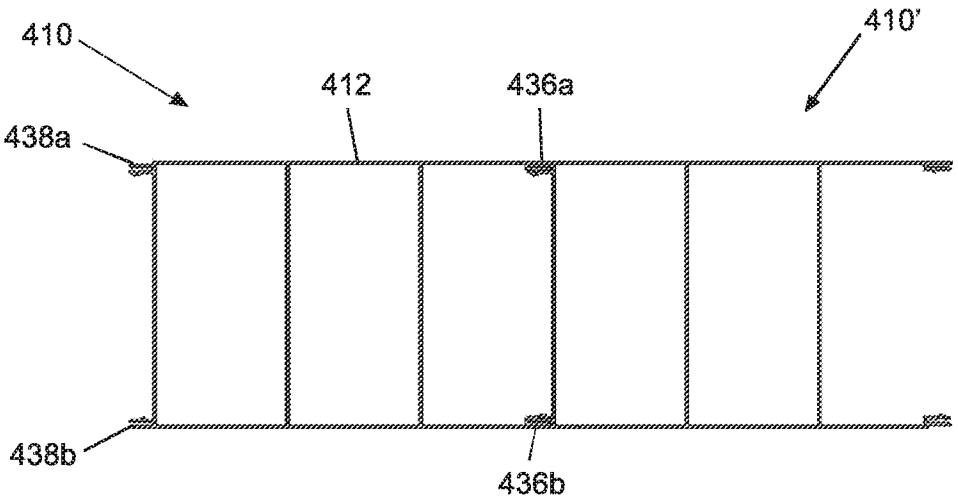
FIG. 4A to 4C show various views of a third embodiment of the building formwork component.
Figure 4C:
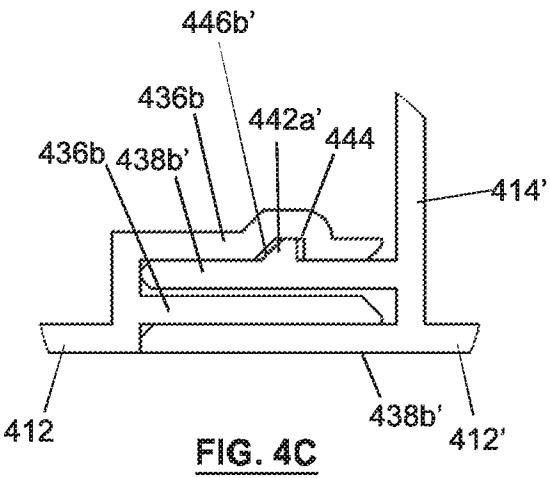
Figure 4B:
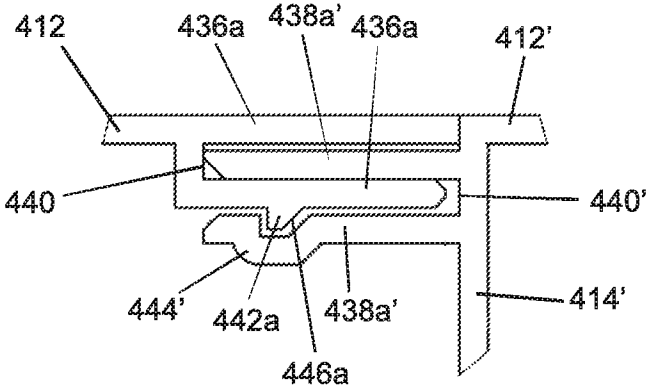

FIGS. 4A to 4C show a further embodiment of a building formwork component 410. In this embodiment, each sidewall 412 comprises a first edge having a pair of parallel flanges 436 extending therefrom, and a second opposing edge having a further pair of parallel flange 438 extending therefrom. The flanges 436, 438 are arranged such that the component 410 may be coupled to a like component 410' by interdigitation (i.e. interleaving) of the flanges 436, 438. Thus, the recesses 440 formed between the flanges 436, 438 are approximately the width of a flange (i.e. so that a flange 436, 438 may be closely received in the recess 440).

The interdigitation of the flanges 436 may help to reduce or eliminate the ingress of water into and through the coupled building components 410, 410'. In particular, the interdigitation arrangement increases the length and complexity of the path (e.g. tortuous) which water (or other liquids) must take in order to pass through the joint.

In other forms, the sidewalls 412 may comprise more flanges 436, 438 and, for example, each edge of the sidewalls 412 may comprise three, four or five parallel flanges extending therefrom. Moreover, the sidewalls of a single component 412 may comprise different numbers of flanges. For example, the first sidewall 412*a* could comprise two flanges at each edge, whilst the second sidewall 412*b* could comprise four flanges at each edge.

In the illustrated form, each of the flanges 436, 438 comprises a pointed and/or filleted distal end. This provides easier alignment of the flanges 436, 438 between and around the corresponding flanges 436', 438' of a like component 410'.

The inner flange 436*a* of the first edge of the first sidewall comprises a ridge 442*a* that extends along the flange 436*a*. Similarly, the inner flange 438*a* of the second edge of first sidewall 412*a* comprises a groove 444*a* extending along the flange 438*a*. On the other hand, the inner flange 436*b* of the first edge of the second sidewall 412*b* comprises a groove 444*b*, and the inner flange 438*b* of the second edge of the second sidewall 412*b* comprises a ridge 442*b*. In other words, the arrangement of the second sidewall 412*b* is such that it is essentially the reverse of the first sidewall 412*a*.

Figure 5A:
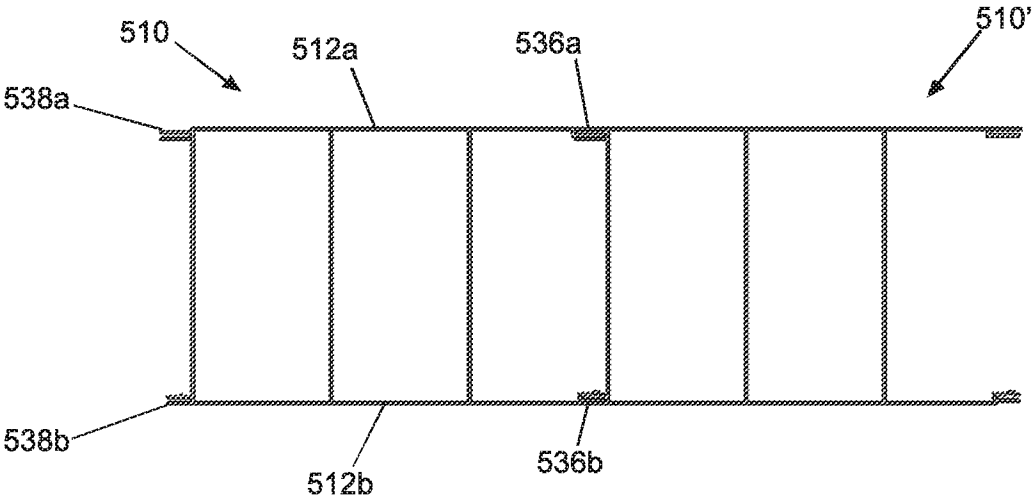
FIG. 5A to 5C show various views of a variation of the third embodiment of the building formwork component.
Figure 5C:
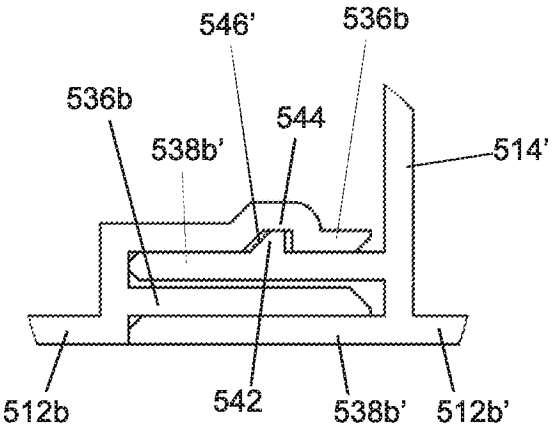
Figure 5B:
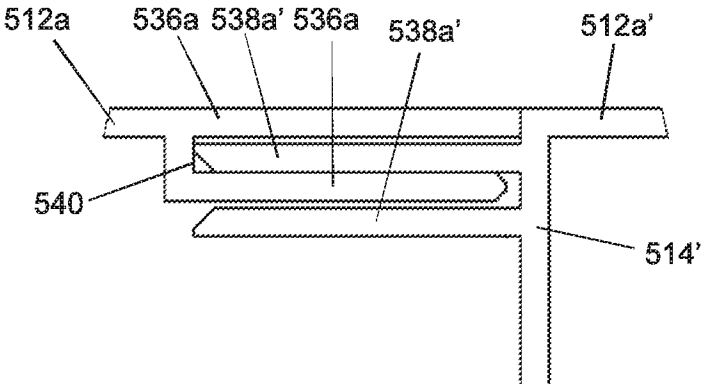
Figure 6A:
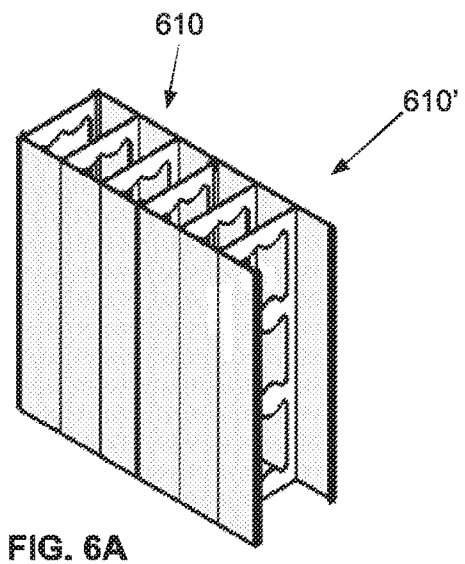
FIG. 6A to 6F show various views of a fourth embodiment of the building formwork component.
Figure 6B:
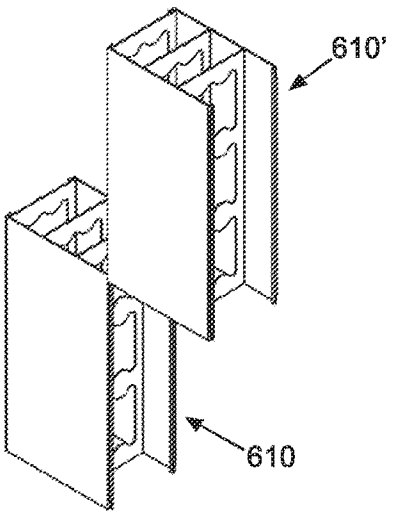
Figure 6C:
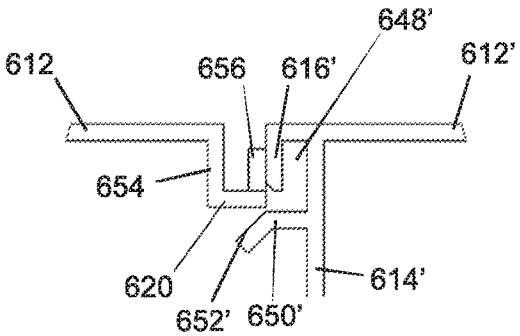
Figure 6D:
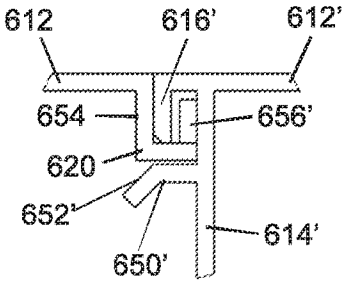
Figure 6E:
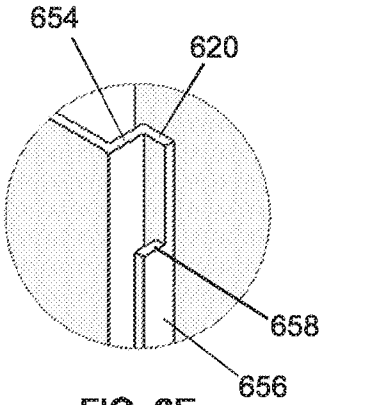
Figure 6F:
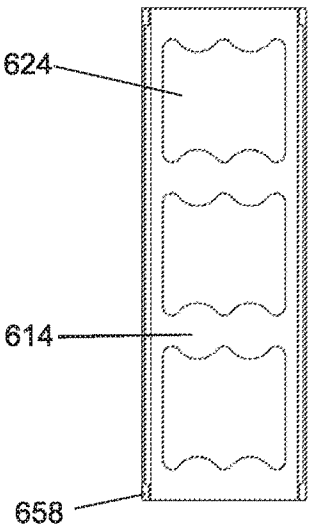

Each groove 444 is formed and located such that it complements a corresponding ridge 442 and may receive a corresponding ridge 442' of a like component 410' when the component 410 is coupled thereto. The ridges 442 and grooves 444, when engaged, inhibit movement of the component 410 away from a like component 410' (i.e. when coupled thereto). They also provide further sealing to prevent the ingress of water into the building formwork components 410, 410'. In the illustrated form, the grooves 444 and ridges 442 are formed in the inner flanges 436, 438, however a person skilled in the art would understand that the grooves and ridges could be located elsewhere (i.e. in another position on the inner flanges 436, 438, or on different flanges) and still provide a retaining and/or waterproofing function. Similarly, whilst the illustrated form comprises two ridges 442 and two grooves 444, other forms of the building formwork component 410 may comprise less or more ridges 442 and grooves 444. For example, the embodiment of the formwork component 510 as shown in FIGS. 5A to 5C comprises a single ridge 542 and a single groove 544; both of which are located on the flanges 536*b*, 538*b* of the second sidewall 512*b*.

Referring again to the embodiment of FIGS. 4A to 4C, each ridge 442 comprises a ramp surface 446, such that when the flange 436, 438 comprising the ridge 442 is inserted between the corresponding flanges 436, 438 of a like component, the ramp surface 446 facilitates the insertion of the flange 436, 438 comprising the ridge 442 (i.e. by gradually displacing the corresponding flanges 436', 438' apart to allow insertion).

In the embodiment shown, the flanges 438*a* of the second edge of the first sidewall 412*a*, and the flanges 436*b* of the first edge of the second sidewall 412*b*, are inset from their respective sidewalls 412 by a distance substantially equivalent to the width of a flange. This means that the sidewalls 412 of the component 410 are flush with the sidewalls 412' of a like component 410' when coupled thereto (requiring minimal surface finish).

Referring now to FIGS. 6A to 6F, a further embodiment of the building formwork component 610 is shown. In this embodiment, the component 610 is coupled to a like component 610' by sliding the components 610, 610' relative to one another such that they become interlocked.

Each sidewall 612 of the component 610 comprises at a first end, a groove 620 in the form of a U-shaped (i.e. in cross-section) channel Each sidewall 612 further comprises, at a second end, a flange 616 inwardly extending perpendicular to the sidewall 612. A recess 648 is formed between each flange 616 and a web 614*a* that extends between the sidewalls 612 adjacent to the flanges 616. Two further flanges 650 extend from this web such that they are generally parallel to the sidewalls 612. These further flanges 650 each comprise a ramp surface 652, which facilitates alignment of a like component 610' within the associated recess 648 (i.e. by guiding the edge of a sidewall 612' of a like component 610' into the recess 648).

A first sidewall 654 of each U-shaped channel 620 (i.e. one "leg" of the U) extends inwardly from its respective first or second sidewall 612. A second sidewall 656 of each channel 620 (i.e. the other "leg" of the U) has a cut-away (as shown in detail in FIG. 6E) therein 658. This cut-away 658 allows the outer surface of each flange 616 (i.e. on the second end of each sidewall 612) to be moved into close facing engagement with the inner surface of the first sidewall 654 of the U-shaped channel 620 (i.e. where the second sidewall 656 of the channel 620 has been cut away). This close facing engagement means that a user (e.g. a labourer) can align the components 610, 610' along the axis of slidable engagement (i.e. such that the flanges 616 are aligned with their corresponding recesses 648). This may provide simpler coupling of components 610, and may reduce time, labour costs and worker fatigue.

The cut-aways 658 in the illustrated form are located at the top and bottom of each U-shaped channel 620. However, in other forms, each channel 620 may only comprise a single cut-away 658 at e.g. the top or the bottom of the channel 620. Alternatively, the channel 620 may comprise one or more cut-aways located intermediate the ends of the channels 620. In this case, corresponding cut-aways may be located on the flanges 616 in order to provide for close facing contact of the flanges 616 with the first sidewalls 654 of the channels 620.

Each web 614 of the illustrated form comprises three apertures 624. Each top and bottom side of the apertures 624 has a wave-like form. The troughs of this wave like form may be utilised for locating reinforcing bars, wiring etc. The profile of the apertures 624 is symmetrical, such that location of the bars is not affected by the orientation of the component 610 (i.e. upright or inverted). It would be understood by a person skilled in the art that, in other forms, the apertures may be other suitable shapes such as circular, ovoid, rectangular, etc.

Whilst a number of specific building formwork component embodiments have been described, it should be appreciated that the building formwork component may be embodied in other forms.

For example, the clipping portions (i.e. flanges, grooves etc.) may extend only partway along the edges of the sidewalls. Moreover, the sidewalls may be curved (e.g. for forming a curved wall structure) or, for example, may have a wave-like form. Alternatively, component may be in the form of a corner structure (i.e. such that it bends at right angles).

In the claims which follow and in the preceding summary except where the context requires otherwise due to express language or necessary implication, the word "comprising" is used in the sense of "including", that is, the features as above may be associated with further features in various embodiments.

Variations and modifications may be made to the parts previously described without departing from the spirit or ambit of the disclosure.

The invention claimed is:

1. A building formwork component configured to provide a mould into which cementitious material is to be poured, the building formwork component comprising first and second spaced sidewalls having two or more webs extending therebetween, each sidewall comprising:

a flange extending inwardly along a first edge of the sidewall such that an outer surface of the flange forms an acute angle with the sidewall so as to define a ramp surface, the first edge having a longitudinal extent; and a groove extending along an opposing second edge of the sidewall, the groove disposed in a portion of the sidewall that extends from an end web of the two or more webs to a free end at the second edge, the second edge having a longitudinal extent;

wherein a first web of the two or more webs extends between the sidewalls in proximity to one of the flange and the groove of the first sidewall and in proximity to one of the flange and the groove of the second sidewall, the first web being spaced inwardly from the one of the flange and the groove of the first sidewall and from the one of the flange and the groove of the second sidewall in a first direction toward an other of the flange and the groove of the first sidewall and toward an other of the flange and the groove of the second sidewall, wherein a second web of the two or more webs extends between the sidewalls at a location spaced from the first web in the first direction, the second web being spaced inwardly from the other of the flange and the groove of the first sidewall and from the other of the flange and the groove of the second sidewall in a second direction opposite the first direction, wherein the component is configured to be coupled to a like component by relative and generally lateral movement of the components towards each other, the lateral movement being transverse to the longitudinal extent of the first and second edges, whereby the flanges are received in respective grooves of the like component, and whereby the ramp surfaces facilitate such coupling by engaging respective second edges of the like component to move the second edges and/or ramp surfaces for snap engagement of the flanges in the grooves; and wherein the sidewalls are sufficiently flexible adjacent at least one of the flange and the groove to allow one of the sidewalls to flex as the second edge of the like component moves along the ramp surface until the flange snaps into the groove.

2. A building formwork component as claimed in claim 1, wherein an inner surface, opposing the outer surface, of each flange forms an acute angle with the sidewall.

3. A building formwork component as claimed in claim 1, wherein the sidewalls are arranged symmetrically such that the flanges are located in a first end region of the component and the grooves are located in an opposing second end region of the component, so that the first web extends between the sidewalls in proximity to the flanges of the first and second sidewalls, the first web being spaced inwardly from the flanges in the first direction toward the grooves of the first and second sidewalls, and so that the second web is spaced inwardly from the grooves of the first and second sidewalls in the second direction.

4. A building formwork component as claimed in claim 1, wherein the sidewalls are arranged asymmetrically, such that one flange and one groove is located in each of a first end region and an opposing second end region of the component.

5. A building formwork component as claimed in claim 1, wherein at least one of the one or more webs extends between the sidewalls in proximity to the flanges, to inhibit movement of the sidewalls adjacent to the flanges during coupling.

6. A building formwork component as claimed in claim 5 wherein, when the component is coupled to a like component, the grooves of the component are located between the respective flanges of the like component.

7. A building formwork component as claimed in claim 1, wherein at least one of the one or more webs extends between the sidewalls in proximity to the grooves, to inhibit movement of the sidewalls adjacent to the grooves during coupling.

8. A building formwork component as claimed in claim 7 wherein, when the component is coupled to a like component, the flanges of the component are located between the grooves of the like component.

9. A building formwork component as claimed in claim 1, wherein each groove is formed so as to correspond to a respective flange of a like component, whereby the flange may be closely received in the groove when the component is coupled to a like component.

10. A building formwork component as claimed in claim 1, wherein each flange is configured such that a distal end thereof abuts an inner surface of a respective groove in the like component to prevent lateral movement of the components away from one another when coupled.

11. A building formwork component as claimed in claim 1 further configured such that when coupled to a like component, each sidewall forms a generally flush surface with the corresponding sidewall of the like component.

12. A building formwork system comprising a plurality of building formwork components, each component being as claimed in claim 1, the components able to be coupled to one another.

13. A building formwork system as claimed in claim 12, further comprising reinforcing arranged to span the coupled components and arranged with respect to one or more apertures in the components.

14. A building formwork system as claimed in claim 13, further comprising a cementitious material located in the spaces formed between the sidewalls and webs of the components.

15. A system comprising:

two building formwork components coupled to one another, each component being as claimed in claim 1;

wherein the recess defined between the end webs of the building formwork components is filled with a cementitious material so as to define a body of cementitious material that extends between the first and second walls of the building formwork components and provides a barrier to water ingress between the building formwork components.

16. A building formwork component configured to provide a mould into which cementitious material is to be poured, the building formwork component comprising first and second spaced sidewalls having two or more webs extending therebetween, each sidewall comprising:

a flange extending inwardly along a first edge of the sidewall such that an outer surface of the flange forms an acute angle with the sidewall so as to define a ramp surface, the first edge having a longitudinal extent, the flange spaced along the sidewall a first distance from the one of the two or more webs nearest to the flange; and a groove extending along an opposing second edge of the sidewall, the groove disposed in a portion of the sidewall that extends from a web nearest to the groove to a free end at the second edge, the second edge having a longitudinal extent, and the groove spaced along the sidewall a second distance from the one of the two or more webs nearest the groove;

wherein the second distance is greater than the first distance such that the groove and the second edge are configured to move laterally to a greater extent than the flange and the first edge;

wherein a first web of the two or more webs extends between the sidewalls in proximity to one of the flange and the groove of the first sidewall and in proximity to one of the flange and the groove of the second sidewall, the first web being spaced inwardly from the one of the flange and the groove of the first sidewall and from the one of the flange and the groove of the second sidewall in a first direction toward an other of the flange and the groove of the first sidewall and toward an other of the flange and the groove of the second sidewall;

wherein a second web of the two or more webs extends between the sidewalls at a location spaced from the first web in the first direction, the second web being spaced inwardly from the other of the flange and the groove of the first sidewall and from the other of the flange and the groove of the second sidewall in a second direction opposite the first direction;

wherein the component is configured to be coupled to a like component by relative and generally lateral movement of the components towards each other, the lateral movement being transverse to the longitudinal extent of the first and second edges, whereby the flanges are received in respective grooves of the like component, and whereby the ramp surfaces facilitate such coupling by engaging respective second edges of the like component to move the second edges and ramp surfaces laterally for snap engagement of the flanges in the grooves;

wherein the sidewalls are sufficiently flexible adjacent at least one of the flange and the groove to allow one of the sidewalls to flex as the second edge of the like component moves along the ramp surface until the flange snaps into the groove; and wherein the two or more webs are arranged such that, when the component is coupled to the like component, the web of the component nearest to the like component is sufficiently spaced from the web of the like component nearest to the component so as to define therebetween a recess configured to receive cementitious material.

17. A building formwork component as claimed in claim 1, wherein the groove is disposed in the second edge of the sidewall, the second edge being located at a free end of the portion of the sidewall that extends from the end web of the one or more webs to the free end.

18. A building formwork component as claimed in claim 1, wherein the groove is disposed in the second edge of the sidewall, the second edge being located at a free end of the portion of the sidewall that extends from the end web of the one or more webs to the free end, the portion being co-linear with the sidewall.

* * * * *